US008966688B2

(12) United States Patent
Blazar

(10) Patent No.: US 8,966,688 B2
(45) Date of Patent: Mar. 3, 2015

(54) WASHABLE MATTRESS TOPPER

(71) Applicant: Jiajing USA, Inc., Richmond (CA)

(72) Inventor: Joseph E. Blazar, Owensboro, KY (US)

( * ) Notice: Subject to any disclaimer, the term of this patent is extended or adjusted under 35 U.S.C. 154(b) by 190 days.

(21) Appl. No.: 13/624,525

(22) Filed: Sep. 21, 2012

(65) Prior Publication Data

US 2013/0074273 A1 Mar. 28, 2013

Related U.S. Application Data

(60) Provisional application No. 61/537,986, filed on Sep. 22, 2011.

(51) Int. Cl.
*A47C 17/00* (2006.01)

(52) U.S. Cl.
USPC ..... 5/691; 5/737

(58) Field of Classification Search
USPC ..... 5/691, 737, 738, 740, 499–502
See application file for complete search history.

(56) References Cited

U.S. PATENT DOCUMENTS

| | | | | |
|---|---|---|---|---|
| 3,148,389 | A | 9/1964 | Lustig | |
| 4,384,381 | A | 5/1983 | Lowthian | |
| 4,508,044 | A | 4/1985 | Downy et al. | |
| 4,536,906 | A | 8/1985 | Varndell et al. | |
| 5,210,891 | A | 5/1993 | Avital et al. | |
| 5,475,881 | A * | 12/1995 | Higgins et al. | 5/737 |
| 5,588,168 | A | 12/1996 | Byrne et al. | |
| 5,638,564 | A | 6/1997 | Greenawalt et al. | |
| 6,026,527 | A | 2/2000 | Pearce | |
| 6,223,371 | B1 | 5/2001 | Antinori et al. | |
| 6,745,419 | B1 * | 6/2004 | Delfs et al. | 5/691 |
| 6,823,546 | B1 | 11/2004 | Hsu | |
| 7,051,389 | B2 | 5/2006 | Wassilefky | |
| 2001/0018777 | A1 | 9/2001 | Walpin | |
| 2004/0139552 | A1 * | 7/2004 | Walters, Jr. | 5/737 |
| 2004/0255385 | A1 | 12/2004 | England | |
| 2005/0204471 | A1 | 9/2005 | Ruiz | |
| 2005/0278852 | A1 | 12/2005 | Wahrmund et al. | |
| 2006/0010608 | A1 * | 1/2006 | DeFranks et al. | 5/738 |

* cited by examiner

*Primary Examiner* — Fredrick Conley
(74) *Attorney, Agent, or Firm* — Conley Rose, P.C.; Kristin Jordan Harkins

(57) ABSTRACT

Embodiments relate generally to a washable mattress topper. The washable mattress topper comprises a cushion element and a fabric cover enclosing and attached to the cushion element in a manner which divides the cushion element into a plurality of compartments.

16 Claims, 3 Drawing Sheets

WASHABLE MATTRESS TOPPER

CROSS-REFERENCE TO RELATED APPLICATIONS

The present application claims priority to U.S. Provisional Patent Application Ser. No. 61/537,986 filed on Sep. 22, 2011, entitled "Washable Mattress Topper," which is hereby incorporated by reference for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

A mattress topper is a cushioned item of removable bedding that sits on the top surface of a mattress. Mattress toppers may be used to promote increased comfort to a user while sleeping and may also protect a mattress hygienically and physically, such as from wear and tear imposed by use. Typically, a removable outer cover of a mattress topper may be washed regularly to maintain clean bedding.

SUMMARY

Aspects of the disclosure may include embodiments of a washable mattress topper for use on a top surface of a mattress, comprising a cushion element comprising open cell foam, and a fabric cover enclosing the cushion element configured to divide the cushion element into a plurality of compartments. In an embodiment, the cushion element has an uncompressed thickness less than about 2.5 inches. In an embodiment, the fabric cover is attached to the cushion element with stitching, and wherein the stitching is applied through both the fabric cover and the cushion element between top and bottom surfaces of the fabric cover. In an embodiment, the thickness of the cushion element at the stitching is approximately a thickness at which the cushion element is compressed. In an embodiment, the fabric cover comprises material configured to resist shrinking and stretching when washed. In an embodiment, the plurality of compartments comprises a border compartment and one or more central compartments, wherein the central compartments comprise a rectangular shape.

Additional aspects of the disclosure may include embodiments of a washable mattress topper for use on a top surface of a mattress, comprising a cushion element, and a fabric cover enclosing the cushion element and attached to the cushion element with stitching that divides the cushion element into a plurality of compartments; wherein the stitching is applied through both the fabric cover and cushion element between top and bottom surfaces of the fabric cover, and the thickness of the cushion element at the stitching is approximately a thickness at which the cushion element is compressed. In an embodiment, the cushion element material comprises open cell foam. In an embodiment, the compartments afford a stability to the cushion element which allows for washing of the topper without substantial break-down or deterioration of the cushion element. In an embodiment, the compartments comprise a border compartment and multiple central compartments wherein the border compartment surrounds the central compartments. In an embodiment, the central compartments are approximately rectangular shaped. In an embodiment, the ratio of the length and the width of the rectangular central compartments is between about 0.5 and about 2.0. In an embodiment, the compartments are approximately triangular shaped. In an embodiment, the stitching forms an approximately helical pattern and the compartments are irregularly shaped. In an embodiment, the stitching is completed using a combination of the quilting methods of tack-and-jump and channel stitching, and in an embodiment, the channel stitching comprises approximately six stitches per inch.

Other aspects of the disclosure may include embodiments of a washable mattress topper for use on a top surface of a mattress, comprising a cushion element comprising open cell foam, and a fabric cover attached to the cushion element with stitching in a manner that divides the cushion element into a plurality of compartments; wherein the fabric cover comprises material configured to resist shrinking and stretching when washed. In an embodiment, the compartments are approximately rectangular shaped. In an embodiment, the fabric cover comprises natural material, synthetic material, or a combination thereof. In an embodiment, the cushion element has an uncompressed thickness between approximately 1 inch and 2.5 inches.

Additional aspects of the disclosure may include embodiments of a washable mattress topper for use on a top surface of a mattress, comprising a cushion element and a fabric cover enclosing the cushion element and attached to the cushion element with stitching that divides the cushion element into a plurality of compartments; wherein the cushion element comprises open cell foam; the stitching is applied through both the fabric cover and cushion element between top and bottom surfaces of the fabric cover; the cushion element has an uncompressed thickness of at least 1 inch; the thickness of the cushion element at the stitching is approximately a thickness at which the cushion element is compressed; the compartments comprise a border compartment and multiple central compartments wherein the border compartment surrounds the central compartments; the central compartments are rectangular and approximately uniform and the ratio of the length and the width of each compartment is between about 0.8 and about 1.25; and the fabric cover comprises material configured to resist shrinking and stretching when washed.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
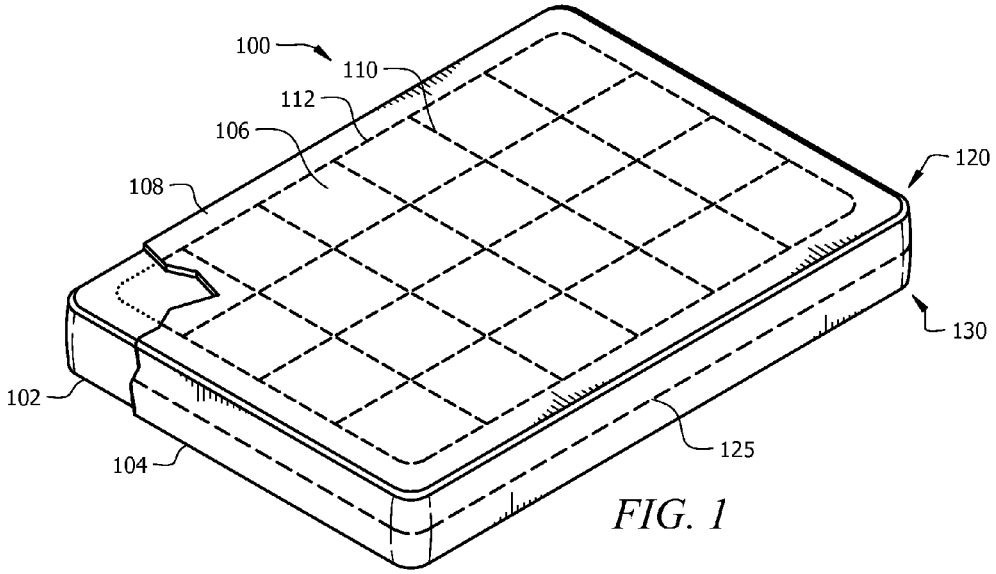
FIG. 1 illustrates a cut-away view of a mattress topper having rectangular central compartments and an outside border compartment according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Embodiments relate generally to mattress toppers (or other cushioned support devices) which may be made washable by compartmentalization of the cushion element (which may comprise an open cell material) of the topper (or device). While the embodiments described below may discuss mattress toppers, it should be understood that use of the term "mattress topper" or "topper" herein is merely exemplary and not limiting, and that embodiments may also relate to other cushioned support devices (such as pillows, mattresses (or elements within a mattress), for example) which may comprise an open cell material. Furthermore, while the washable mattress topper examples herein may generally be discussed in the sleeping context or for use on the top surface of a mattress, washable cushioned support devices (with similar features) may have other uses (for example, seating cushions or lumbar support cushions), all of which are within the scope of this disclosure.

Mattress toppers generally are designed for the purpose of increased comfort while sleeping and to protect mattresses hygienically and/or from wear and tear. It is typically not common practice to wash an entire topper because it may cause deterioration of the cushioning element of the topper. However, a washable mattress topper may be desired to allow for more hygienically clean bedding. In an embodiment, open cell (or reticulated) foam may be used as a cushion element for mattress toppers (or other cushioned support devices), wherein open cell foam may be desirable based on its ability to conform to the shape of the body. Due to the nature of open cell foam, it may not be durable when washed by itself, wherein the foam material tends to deteriorate or break-down if washed. It may be desirable that a mattress topper be machine or hand washable for hygienic reasons, including the elimination of dirt, allergens and other irritants (e.g. dust mites, bed bugs, mold and dead skin). The present disclosure teaches the attachment of a fabric cover to the cushion element of a mattress topper in a manner that creates a plurality of compartments within the cushion element, wherein the fabric cover permanently encloses the cushion element. In this disclosure, "permanently enclose" means that it may be possible to remove the fabric cover by laboriously cutting or otherwise removing the attachment between the cover and the cushion element (which may be stitches, for example), but this removal may effectively destroy or ruin the mattress topper. At the least, it would be very inconvenient to remove the fabric cover, and removal would defeat at least one of the benefits of the invention, including the ability to wash the topper without having to remove and later reinsert the cushion element. In the language of this disclosure, "permanently" means that the fabric cover remains in enclosure of the cushion element for the duration of the functional life of the disclosed mattress toppers.

Not wishing to be bound by theory, it is thought that the compartments of the cushion element may afford a stability which would allow the mattress topper to be machine or hand washed on a regular basis without deterioration of the cushion element, thereby extending the life of the mattress topper and its overall value to a consumer. In one embodiment the cushion element of the mattress topper may comprise open cell (or reticulated) foam, which may comprise materials such as polyurethane, latex, gel or another such material that would provide cushioning properties. In an embodiment, the open cell foam material may comprise a particular cell size, cell wall strength, elasticity, as well as other cell properties, wherein the cell properties may be variable (and/or governable) based on methods of manufacturing the foam. Someone skilled in the art would be able to select a foam material (or a method of manufacturing a foam material) with certain properties to achieve a desired design of a cushioned support device, wherein the design variables may include comfort, support, weight, ability to absorb water, and/or ability to eliminate water. For example, the cell properties of a foam material may affect the ability and/or rapidity of a foam to dry after becoming wet (such as in a washing/drying process, for example) as well as the support provided by the foam material. In some embodiments, a person skilled in the art may choose a foam material wherein the comfort or support properties may be compromised if a rapidly drying foam is desired, while in another embodiment, a foam material may be chosen wherein the rapidity of drying is compromised for increased comfort or support. In other words, different characteristics of foam materials may compete such that a balance may be considered based on the desired application of the foam material. The material of the cushion element may also comprise air flow characteristics that may allow for an increased amount of air flow through the material, and therefore allow for washing of the material. In an embodiment, the topper may be designed and sized to fit on top of a particular standard size of mattress, such as a twin, twin XL, full, queen, king or California king, as well as nonstandard sizes.

Figure 2A:
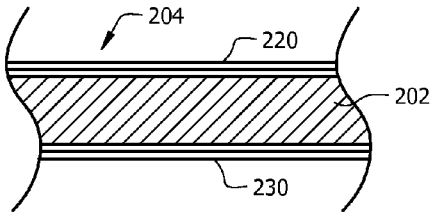
FIG. 2A illustrates a cross-sectional view of a mattress topper with an uncompressed cushion element according to an embodiment of the disclosure.
Figure 2B:
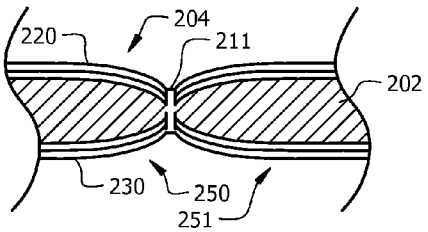
FIG. 2B illustrates a cross-sectional view of a mattress topper with a compressed cushion element and an attachment according to an embodiment of the disclosure.

In the embodiment shown in FIG. 1, a mattress topper 100 may consist of a cushion element 102 with a fabric cover 104 enclosing and attached to the cushion element 102 in a manner that creates multiple central compartments 106 and a border compartment 108. In an embodiment, the cushion element 102 may comprise open cell (or reticulated) foam. The fabric cover 104 may comprise natural materials (such as cotton, linen, wool, silk, or bamboo, for example), synthetic materials (such as polyester, rayon, Dacron, nylon, acrylic, Lycra, or olefin fibre, for example), or a combination (or blend) thereof. Any combination and/or construction of natural materials and/or synthetic materials may be suitable for the fabric cover 104, and the cover 104 may be configured so as to resist significant shrinking and/or stretching of the fabric when washed and/or dried. This may be accomplished by preshrinking the fabric cover material, using a specific type of weave for the material, and/or using specific material(s) for the fabric cover that are known to be stable. Typically, the fabric cover 104 may comprise a woven material. In an embodiment, the fabric cover 104 may be attached to the cushion element 102 by stitching with thread 110 and 112 through both the fabric cover 104 and the cushion element 102. In an embodiment, stitching continuous lines with thread may achieve compartmentalization of the mattress topper 100. "Continuous" may refer to stitching without breaking/cutting the thread at any point in a particular line/distance. Although, in an embodiment, the thread may be visible on one side of the fabric cover 108 in a dashed fashion (such that the stitching alternates between two surfaces 120 and 130 of the fabric cover 104), it may be considered a continuous stitch if the thread used to make the stitch is not broken and/or cut along a specific line. In an embodiment, a stitching pattern on a topper 100 (such as may be formed by stitching 110 and 112) may be formed by one or more continuous lines of stitching. The stitching 110 and 112 may be applied through both the fabric cover 104 and the cushion element 102 (i.e. between the top 120 and bottom 130 surfaces of the fabric cover 104) so that, in an embodiment, the distance between the top 120 and bottom 130 of the mattress topper 100 at the stitching 110 and 112 may be between about ⅛ inch and about ¾ inch. Generally, the thickness of the cushion element 102 at the stitching 110 and 112 may be a thickness at which the cushion element 102 is compressed, wherein the cushion element 102 may be approximately fully compressed or partially compressed, as can be seen in FIGS. 2A-2B. Additionally, the compression at the stitching 110 and 112 may be accomplished by applying a specific force to the cushion element 102.

FIG. 2A shows a cushion element 202 in an uncompressed state. In an embodiment, the top surface 220 and the bottom surface 230 of the fabric cover 204 may be adjacent to the cushion element 202. FIG. 2B shows the cushion element 202 at a point of attachment 211 with the fabric cover 204. The cushion element 202 may be in a compressed state at the attachment point 211, and, as can be seen in FIG. 2B, the attachment 211 may attach the top 220 and bottom 230 surfaces of the fabric cover 204 to the cushion element 202 by threading all the way through the cushion element 202, thereby creating two compartments 250 and 251 of the cushion element 202 on either side of the attachment point 211. As can be seen from FIG. 2B, the cushion element 202 may have a compressed thickness at the attachment point 211, and it may be substantially less than the uncompressed thickness of the cushion element 202.

While one embodiment of compartmentalization of the mattress topper may be achieved by stitching continuous lines with thread, other methods are equally contemplated, such as stitching without continuous lines, fusing, use of adhesive, use of rivets, use of buttons or some combination thereof. Additionally, an embodiment of the mattress topper shown in FIG. 1 may comprise a connection 125 of the top 120 and bottom 130 surfaces of the fabric cover 104, wherein the connection may comprise stitching and may be located at the edges of the topper 100. The top and bottom surfaces may be connected on at least one edge, and may also comprise two separate pieces connected at all four edges.

In an embodiment, the stitching 110 and 112, operable to attach the cushion element and fabric cover, may be in a pattern such that the number of stitches per inch may be between about 4 and about 8, and in some embodiments, may comprise between approximately 5 to 7 stitches per inch. In a typical embodiment, the stitching pattern 110 and 112 may comprise approximately 6 stitches per inch. In an embodiment, the thread used for the stitching may comprise Nylon and may have a thread weight of at least approximately Tex 6 (wherein Tex is the mass in grams of 1000 meters of thread). In other embodiments, the thread may comprise other materials such as cotton, polyester, a cotton-polyester blend, rayon, silk, or wool, which may be chosen based on the desired qualities of the thread such as strength, thickness, appearance, and/or cost. In an embodiment, the stitching 110 and 112 may be completed using one or more quilting methods, which may include channel stitching and/or tack-and-jump. In an embodiment, the fabric cover 104 and cushion element 102 may first be tacked together (i.e. tacked with thread from one surface of the fabric cover to the other surface through the cushion element) in a plurality of points on the topper 100 (which may be located within the stitching pattern 110 and 112) using a tack-and-jump method. Then, channel stitching may be used to form the final pattern of stitching 110 and 112 on the topper 100 that may ultimately create the plurality of compartments 106 and 108 in the topper 100. In an embodiment, the channel stitching may connect the plurality of points that may be tacked by the tack-and-jump method. The embodiment of attaching the fabric cover 104 and cushion element 102 combining the use of tack-and-jump and channel stitching may allow for increased stability of the cushion element 102 in the stitching pattern. In an embodiment, the tack-and-jump followed by channel stitching may firmly fix the cushion element 102 within the pattern of compartmentalization, such that during washing and/or drying, the cushion element 102 and/or the fabric cover 104 may not develop puckers or deformities at or around the stitching 110 and 112.

The size and/or shape of the compartments may affect the comfort of the topper 100 for a user as well as manufacturing costs associated with the topper 100. In the embodiment shown in FIG. 1, the central compartments 106 separated by stitching 110 may comprise a rectangular shape. Additionally, the rectangular central compartments 106 may be approximately uniform wherein the ratio of the length to the width of the central compartments 106 may be between about 0.4 and 2.5. In another embodiment, the ratio of the length to the width of the central compartments 106 may be between about 0.5 and 2.0, such that the longer side is no more than twice the length of the shorter side. In an embodiment where in the longer side is no more than twice the length of the shorter side, elongation of an area of the cushion element (which may cause deformation or alteration of the rigidness and/or comfort properties of the cushion element when washed) may be avoided. In yet another embodiment, the ratio of the length to the width of the central compartments 106 may be between about 0.8 and 1.25, such that the central compartments 106 have an approximately square shape. In an embodiment, the length and width of the compartments may be between about 5 inches and about 15 inches. In a typical embodiment, the central compartments 106 may be about 8 inches in length and about 8 inches in width. Uniformity provided by regularly shaped compartments 106 (such as a square or triangle, for example) may provide stability to the cushion element 102 (to prevent deterioration for example) during washing and/or drying to allow for a longer lifespan of the topper 100. In an embodiment, the border compartment 108 may be operable to provide stability to the topper 100, especially at the outer edges. In the embodiment shown in FIG. 1, the border compartment 108 may completely surround the central compartments 106, wherein the border compartment may be separated from the central compartments by stitching 112. The border compartment 108 may typically be continuous around the outside edge of the topper 100, as shown in FIG. 1, and may, in an embodiment, have a width of between about 3 inches and about 6 inches. In an embodiment, the border compartment 108 may comprise a width between about 2 inches and about 4 inches, while in another embodiment, the border compartment may comprise a width of less than 3 inches. In a typical embodiment, the width of the border compartment may be approximately 3 inches.

In an embodiment, a topper 100 without a border compartment 108 may develop irregularity in deformation or decomposition at the edges of the topper caused by washing and/or drying of the topper. Typically, a topper without a border compartment may have a lifespan of about 25 to 30 washes, whereas a topper with a border compartment may have a lifespan of at least 40 washes (which may be the equivalent of 20 years with 2 washings a year). The border compartment 108 may create strength for the cushion element 102 at the outer edges, especially at the corners, and serve to reinforce them during washing and/or drying. Additionally, the border compartment 108 may reinforce the stability of the topper 100 during regular use of the topper 100, such as when a user moves onto or off of the topper 100 or to a different position on the topper 100.

In an embodiment, the cushion element 102 may comprise an uncompressed thickness up to approximately 2.5 inches. An embodiment of the cushion element 102 may have an uncompressed thickness of at least 1 inch and may typically be about 1.5 inches thick. Different factors that may be considered to determine an optimal thickness of a topper 100 may include user comfort, ability to be washed and/or dried, and/or ability to be sewn through with stitching to create compartments. In an embodiment, the thickness of the cushion element 102 may be such that it allows for a user to handle (i.e. move, wash, and/or dry) the topper 100 with relative ease while still retaining comfort properties of the topper 100. A desired thickness may also depend on the density of the topper 100, wherein a typical embodiment of the cushion element 102 may comprise a density of about 3 lb. per board foot (wherein 1 lb. per board foot may be the equivalent of 12 lb. per cubic foot). Because a typical mattress topper 100 may spend the majority of its lifespan on the top surface of a mattress, the topper 100 may not be made to be easily rolled or folded for storage; therefore the thickness of the topper may not need to be designed with folding or rolling characteristics.

Figure 3:
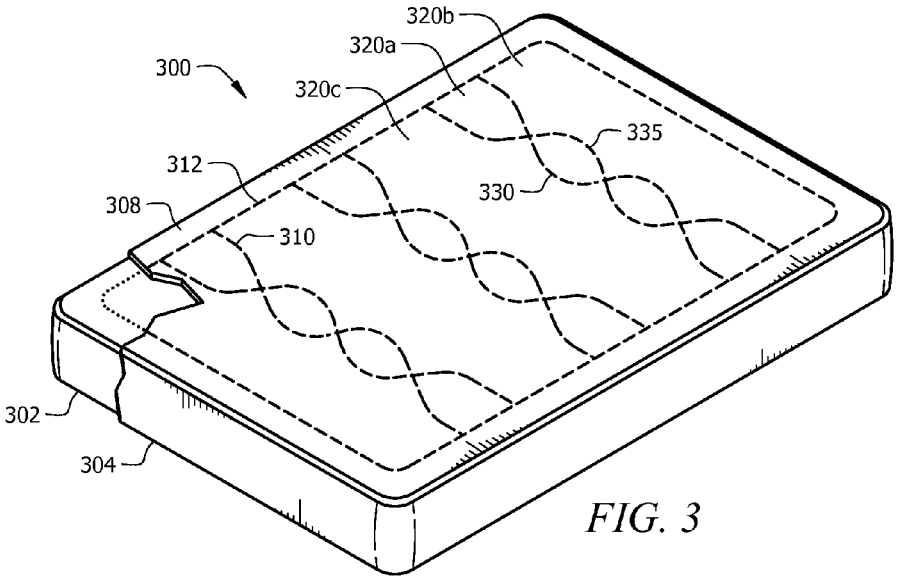
FIG. 3 illustrates a cut-away view of a mattress topper having an outside border compartment and central compartments of various shapes and sizes created using a helical pattern according to an embodiment of the disclosure.
Figure 4:
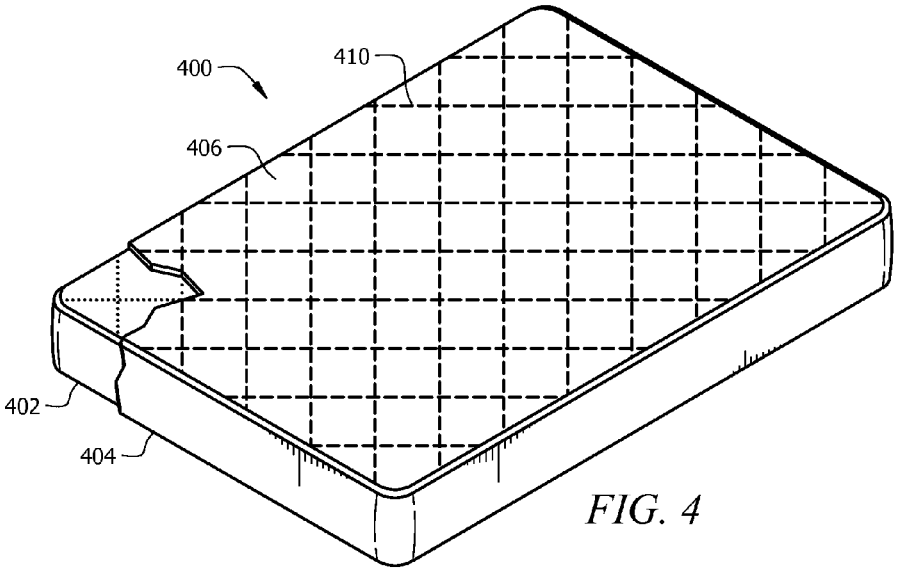
FIG. 4 illustrates a cut-away view of a mattress topper having multiple polygon shaped compartments without an outside border compartment according to an embodiment of the disclosure.
Figure 5:
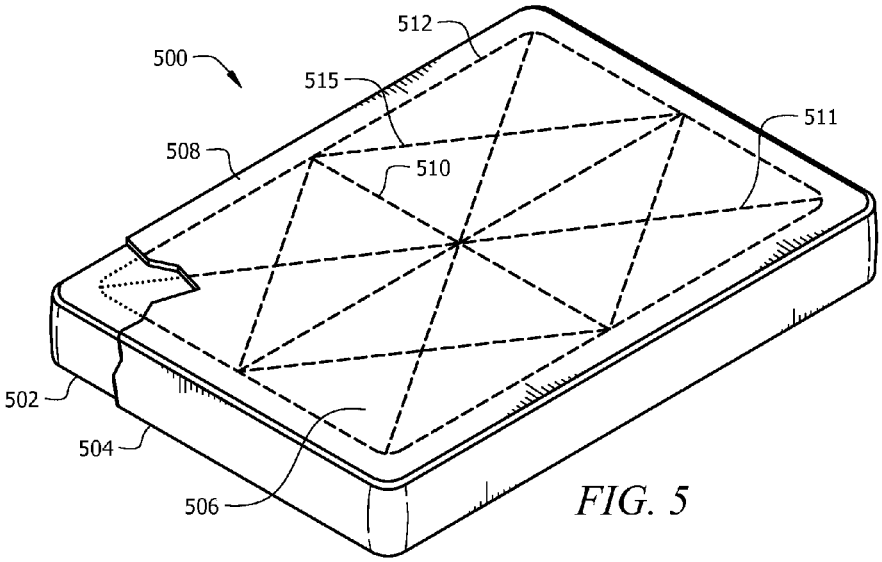
FIG. 5 illustrates a cut-away view of a mattress topper having triangular central compartments and an outside border compartment according to an embodiment of the disclosure.

FIG. 3, FIG. 4, and FIG. 5 show alternative embodiments of patterns for the attachment to create compartmentalization. While FIG. 3, FIG. 4 and FIG. 5 have been provided for exemplary purposes, other patterns of compartmentalization may be included in the scope of this disclosure.

Shown in FIG. 3, an embodiment of a mattress topper 300 is briefly described. The mattress topper 300 comprises a cushion element 302, a fabric cover 304, and a border compartment 308 substantially as described above with reference to the cushion element 102, fabric cover 104, and border compartment 108 of FIG. 1. In the embodiment of FIG. 3, the mattress topper 300 may comprise a different pattern of stitching 310 and 312 that may provide a plurality of central compartments with various shapes and sizes 320*a*, 320*b* and 320*c*. In an embodiment, the stitching 312 may form the border compartment 308 and the stitching 310 may form the various shapes of central compartments 320*a*, 320*b* and 320*c*. In the embodiment of FIG. 3, the stitching 310 may be in a helical pattern in a horizontal or vertical direction across the topper 300. The term "helical" may refer to continuously stitched lines that may be interwoven or interlocking, and may approximately comprise the shape of two sine waves (one inverse of the other) which may cross at multiple locations along their length. An exemplary helical pattern shown in FIG. 3 may comprise at least two continuous stitches 330 and 335 which may cross each other multiple times (in an interwoven fashion) and may form three differently shaped central compartments 320*a*, 320*b* and 320*c*, wherein compartment 320*a* may be formed between the two helical stitches 330 and 335, compartment 320*b* may be formed between a first side of the helical stitches 330 and 335 and the stitches 312 forming the border compartment 308, and compartment 320*c* may be formed between a second side of the helical stitches 330 and 335 and a first side of another set of helical stitches. In an embodiment, the topper 300 may comprise any number of helical patterned stitches 310, which may follow any direction with respect to the topper 300, so long as the thickness of the cushion element 302 is not compromised. Additionally, design may be considered for the stitching pattern, and the exemplary pattern in a helical shape may be considered aesthetically pleasing to a user.

Shown in FIG. 4, another embodiment of a mattress topper 400 is briefly described. The mattress topper 400 may comprise a cushion element 402 and a fabric cover 404 substantially as described above with reference to the cushion element 102 and fabric cover 104 of FIG. 1. In the embodiment of FIG. 4, mattress topper 400 may comprise a different pattern of stitching 410 which provides a plurality of polygon shaped compartments 406. In an embodiment, the stitching 410 may continue to the edge of the mattress topper 400, and the compartments 406 may comprise a uniform, rectangular shape. In the embodiment of FIG. 4, the stitches 410 may follow a diagonal direction with respect to the mattress topper 400, but in other embodiments, the stitches might be vertical and/or horizontal. Additionally, the embodiment of FIG. 4 may show rectangular shaped central compartments 406, but in other embodiments, the compartments may have more or less than four sides and may comprise right angles, obtuse angles, and/or acute angles.

Shown in FIG. 5, another embodiment of a mattress topper 500 is briefly described. The mattress topper 500 may comprise a cushion element 502, a fabric cover 504 and a border compartment 508 substantially as described above with reference to the cushion element 102, fabric cover 104, and border compartment 108 of FIG. 1. In the embodiment of FIG. 5, the mattress topper 500 may comprise a pattern of stitching 510, 511 and 512 which may provide a plurality of triangular central compartments 506. In the embodiment shown in FIG. 5, the stitching 511 may follow a diagonal direction with respect to the topper and the stitching 510 may follow a vertical and/or horizontal direction with respect to the topper, thereby forming the triangular central compartments 506. In another exemplary embodiment, the topper 500 may comprise additional stitching 515 which may alter the size and or shape of the central compartments 506.

As can be seen from the embodiments shown in FIGS. 1-5, any combination of vertical, horizontal, diagonal and/or curved stitches (which may be any number and/or length) may be used to form the central and/or border compartments of the topper and may be included in the scope of this disclosure. However, constraints may be placed on the size of the compartments to preserve the integrity and/or thickness of the cushion element of the topper. In other words, the compartments (including central and border compartments) may be small enough and/or close enough together to moderate or attenuate disintegration of the cushion element during a washing and/or drying process, while not being so small and/or close together as to compromise the integrity/thickness (and therefore the comfort properties) of the cushion element. Additionally, the complexity of the stitching pattern and/or the amount of thread used may be limited by manufacturing costs of the topper.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as comprises, includes, and having should be understood to provide support for narrower terms such as consisting of, consisting essentially of, and comprised substantially of. Use of the term "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented. For example, the mattress topper is contemplated as having different shaped compartments formed by stitching through the fabric and cushioning element.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A washable mattress topper for use on a top surface of a mattress, comprising:

a cushion element; and a fabric cover enclosing the cushion element and attached to the cushion element with stitching that divides the cushion element into a plurality of compartments;

wherein:

the stitching is applied through both the fabric cover and cushion element between top and bottom surfaces of the fabric cover; and the thickness of the cushion element at the stitching is approximately a thickness at which the cushion element is compressed;

the compartments comprise a single border compartment and multiple central compartments, wherein the border compartment surrounds the central compartments; and the border compartment and the central compartments all have approximately the same thickness of cushioning, resulting from being formed by division of the same cushion element via stitching.

2. The topper of claim 1, wherein the cushion element has an uncompressed thickness less than about 2.5 inches.

3. The topper of claim 1, wherein the fabric cover comprises natural material, synthetic material, or a combination thereof.

4. The topper of claim 1, wherein the cushion element has an uncompressed thickness between approximately 1 inch and approximately 2.5 inches.

5. The topper of claim 1, wherein:

the central compartments are rectangular and approximately uniform in size, and the ratio of the length and the width of each compartment is between about 0.8 and about 1.25.

6. The topper of claim 1, wherein the stitching divides the cushion element into the plurality of compartments, and wherein the stitching comprises a combination of tack-and-jurnp stitching and channel stitching.

7. The topper of claim 6, wherein the channel stitching connects points tacked by the tack-and-jump stitching, and wherein the channel stitching comprises 4 to 8 stitches per inch.

8. The topper of claim 1, wherein the cushion element material comprises open cell foam.

9. The topper of claim 1, wherein the compartments afford a stability to the cushion element which allows for washing of the topper without substantial break-down or deterioration of the cushion element.

10. The topper of claim 1,
wherein:

the entire fabric cover is configured to resist shrinking and stretching when washed.

11. The topper of claim 1, wherein the central compartments are approximately rectangular shaped.

12. The topper of claim 11, wherein the ratio of the length and the width of the rectangular central compartments is between about 0.5 and about 2.0.

13. The topper of claim 1, wherein the compartments are approximately triangular shaped.

14. The topper of claim 1, wherein the stitching forms an approximately helical pattern and the compartments are irregularly shaped.

15. The topper of claim 1, wherein the stitching comprises a combination of tack-and-jump stitching and channel stitching.

16. The topper of claim 15, wherein the channel stitching comprises approximately six stitches per inch.

* * * * *